US006250520B1

(12) United States Patent
Richard et al.

(10) Patent No.: US 6,250,520 B1
(45) Date of Patent: Jun. 26, 2001

(54) PLANT FOR TRANSFERRING LIQUID METAL, METHOD OF OPERATION, AND REFRACTORIES

(75) Inventors: Francois-Noël Richard, Nancy (FR); Jose Simoes, Saint-Ghislain (BE)

(73) Assignee: Vesuvius Crucible Company, Wilmington, DE (US)

( * ) Notice: Subject to any disclaimer, the term of this patent is extended or adjusted under 35 U.S.C. 154(b) by 0 days.

(21) Appl. No.: 09/284,166

(22) PCT Filed: Oct. 15, 1997

(86) PCT No.: PCT/IB97/01281

§ 371 Date: Jun. 16, 1999

§ 102(e) Date: Jun. 16, 1999

(87) PCT Pub. No.: WO98/17421

PCT Pub. Date: Apr. 30, 1998

(30) Foreign Application Priority Data

Oct. 17, 1996 (FR) ..... 96 12664
Dec. 20, 1996 (FR) ..... 96 15928

(51) Int. Cl.[7] ..... B22D 41/08
(52) U.S. Cl. ..... 222/590; 222/600; 222/603
(58) Field of Search ..... 222/590, 591, 222/603, 600

(56) References Cited

U.S. PATENT DOCUMENTS

| | | |
|---|---|---|
| 3,887,117 | 6/1975 | Fehling . |
| 4,365,731 | 12/1982 | Fehling et al. . |
| 4,480,770 | 11/1984 | Goursat et al. . |
| 4,555,050 | 11/1985 | Shiefer et al. . |
| 4,576,317 | 3/1986 | Wenger . |
| 4,660,808 | 4/1987 | Daussan et al. . |
| 4,721,236 | 1/1988 | Muschner . |
| 5,390,902 | 2/1995 | Szadkowski . |
| 6,016,940 | 1/2000 | Florent et al. . |

FOREIGN PATENT DOCUMENTS

| | | |
|---|---|---|
| 0 171 589 A1 | 2/1986 | (EP) . |
| 2529493 | 1/1984 | (FR) . |
| 2529493 A1 | 1/1984 | (FR) . |
| 1-309769 | 12/1989 | (JP) . |

*Primary Examiner*—Scott Kastler
(74) *Attorney, Agent, or Firm*—James R. Williams

(57) ABSTRACT

The invention relates to a plant for transferring liquid metal, in particular steel, between an upstream container (2) and a downstream container (10), comprising: an upstream container (2); a tapping spout (28); a downstream container (10), a flow regulator (26) for regulating the flow of liquid metal through the tapping spout (28); a set of refractory assemblies (8, 12, 30, 32, 64, 66, 74) which are placed between the upstream container and the downstream container, delimiting the tapping spout (28) via which the liquid metal flows from the upstream container (2) into the downstream container (10), each refractory assembly of the tapping spout (28) having at least one mating surface (22) forming a joint with a corresponding surface of an adjacent refractory assembly; a shroud channel (18; 40) placed around the tapping spout (28) near at least one mating surface (22) between refractory assemblies (8, 12, 30, 32, 64, 66, 74), this shroud channel having an inlet (44) capable of allowing the introduction of materials; in which plant means (32, 34; 36) are provided for introducing a sealing agent into the shroud channel (40; 18).

26 Claims, 5 Drawing Sheets

FIG.2
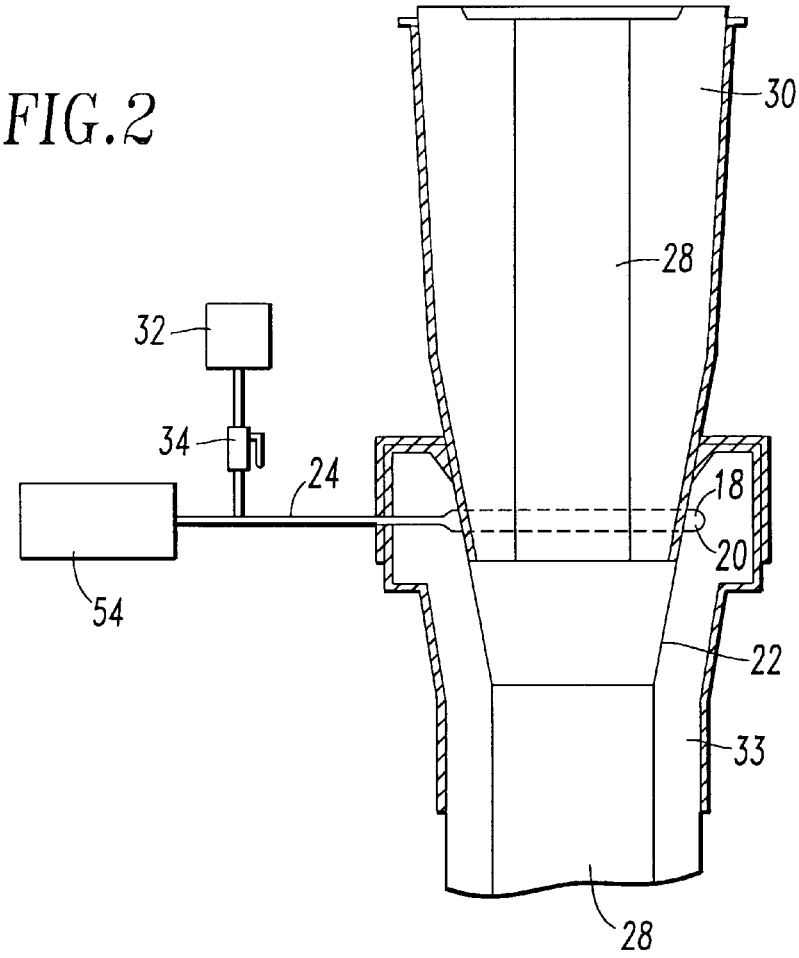
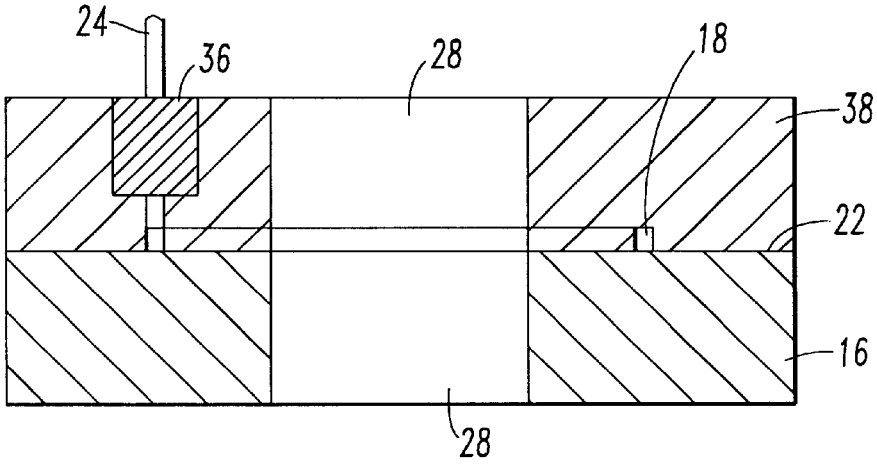
FIG.3

FIG.4
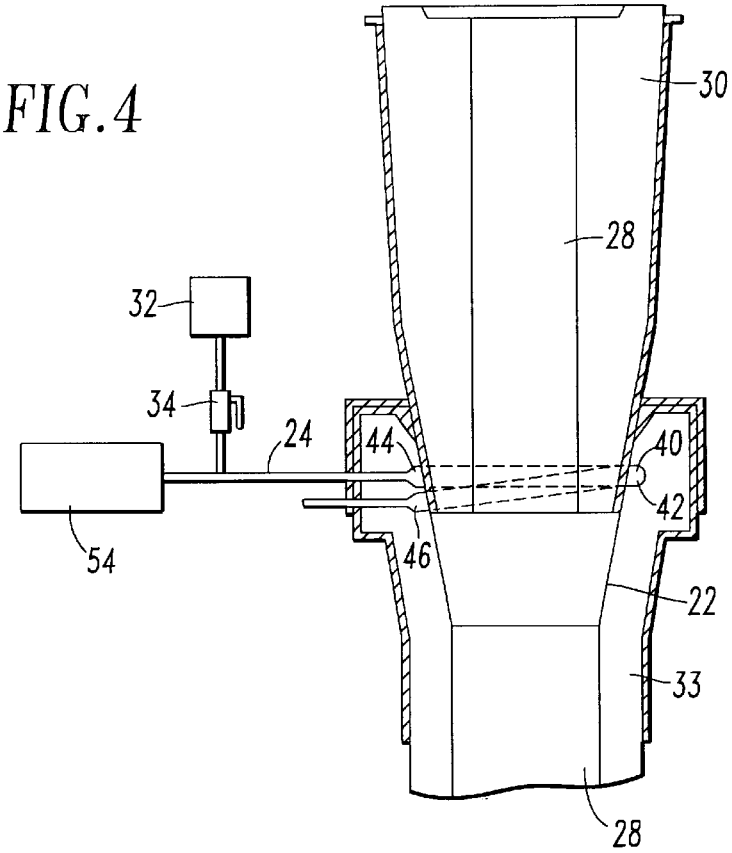
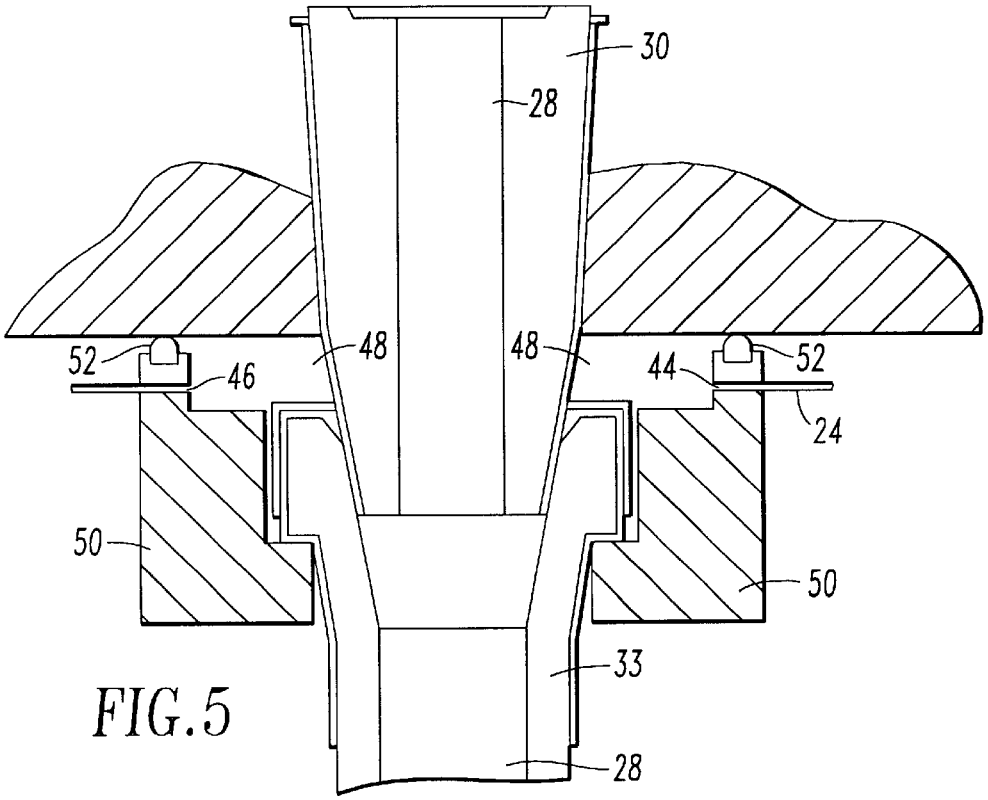
FIG.5

PLANT FOR TRANSFERRING LIQUID METAL, METHOD OF OPERATION, AND REFRACTORIES

FIELD OF THE INVENTION

The present invention relates to an apparatus and a method for transferring liquid metal from a first container to a second container or mold, wherein a sealing agent is used to reduce oxidation of the liquid metal.

BACKGROUND OF THE INVENTION

The present invention relates to plants for transferring liquid metal from an upstream container to a downstream container, comprising: an upstream container; a downstream container; a tapping spout; a flow regulator for regulating the flow of liquid metal through the taphole; a set of refractory assemblies which are placed between the upstream container and the downstream container, delimiting the tapping spout via which the liquid metal flows from the upstream container into the downstream container, each refractory assembly of the tapping spout having at least one mating surface forming a joint with a corresponding surface of an adjacent refractory assembly; a shroud channel placed around the tapping spout near at least one mating surface between refractory assemblies.

Refractory assembly is understood to mean a monolithic component consisting of one or more types of refractory, possibly comprising other constituents, for example a metal shell. Flow regulator is understood to mean any type of device used in this technical field such as a stopper rod, a slide gate valve, and also a simple restriction.

In a plant of this type, the presence of a flow regulator in the tapping spout means that, when the liquid metal is flowing, there is a pressure drop. If the tapping spout is not perfectly sealed, air can be drawn into it because of this reduced pressure. This is generally the case, in particular at the mating surfaces between the various refractory assemblies which form the tapping spout, the sealing of which is difficult to achieve and to maintain. Air is therefore drawn in, which results in a degradation in the quality of the metal.

In order to solve this problem, it is known to create, by means of a shroud channel, an overpressure of an inert gas around the tapping spout, near each critical mating surface. Inert gas is understood to mean here a gas which does not impair the quality of the tapped metal. Among the gases normally used may be found rare gases, such as argon, but also other gases such as nitrogen or carbon dioxide.

According to a known embodiment, a groove is formed in at least one of the mating surfaces between two adjacent refractory assemblies. This groove is fed with pressurized inert gas and thus forms a closed annular shroud channel placed surrounding the tapping spout. Such an embodiment is known, for example, from U.S. Pat. No. 4,555,050 or EP 0,048,641.

In the particular case in which successive refractory assemblies are able to move with respect to each other, the use of a shroud channel is also known. French Patent Application FR 74/14636 describes a slide gate valve having two plates, each plate having a hole through which the liquid metal passes, the sliding of one plate with respect to the other enabling the flow of liquid metal to be regulated. These two plates each have, along their common mating plane, a U-shaped groove placed head to tail with respect to the other groove so that the arms of one of the Us overlap the arms of the other U, and thus produce a closed annular shroud channel whatever the relative position of the two plates.

According to another known construction, a closed chamber is provided which surrounds the outer part of the mating surfaces, and the chamber is fed with pressurized inert gas. Such a construction is known, for example, from U.S. Pat. No. 4,949,885.

All these known arrangements are used to replace the induction of air by the induction of inert gas, thereby eliminating the chemical problem associated with the liquid metal coming into contact with air.

However, these known solutions have several disadvantages.

The intake of gas into the tapping spout is not eliminated. It is even increased because the groove or the chamber is at an overpressure. This is a drawback particularly in the case of transfer of metal between a tundish and a continuous-casting mould.

The gas taken into the tapping spout ends up in the mould and causes perturbations therein, such as turbulence, movement of the coverage powder and the trapping of this powder in the liquid metal. The gas entrained into the mould may furthermore become dissolved in the liquid metal and subsequently create defects in the solidified metal.

In addition, in order to reduce the speed of the liquid metal as it enters the mould, and thus to reduce the turbulence in the mould, many jet shroud tubes have an outlet cross-section greater than their inlet cross-section.

The speed of flow of the liquid metal then decreases gradually. The presence of a significant quantity of gas in the tube may prevent correct operation of this type of tube: the flow may separate from the walls of the tube and the liquid metal therefore drops as a jet into the mould.

The quality of a mating surface between two refractory assemblies may vary in an uncertain way while the tapping spout is being used. Defects may appear. In particular, in the case of refractory assemblies which can move with respect to each other, wear of the mating surface may lead to significant leakage. Among plants having movable refractory assemblies may be found regulating slide gate valves and devices for changing a jet shroud tube.

One possibility, in order to limit the intake of gas into the tapping spout, is to regulate the flow of inert gas injected into the shroud channel. In this case, if the sealing defect becomes significant, it may happen that the flow rate of inert gas is no longer high enough for only the inert gas to enter the tapping spout. In this case, the pressure in the shroud channel becomes negative and ambient air can be drawn into the tapping spout. On the other hand, if the sealing is good, a fixed flow of inert gas is nevertheless injected into the shroud channel, the pressure therein increases and the inert gas enters the tapping spout without this really being necessary.

Another possibility is to regulate the pressure of the inert gas as it is being injected into the shroud channel. In this case, if the sealing defect becomes significant, the flow rate of inert gas being taken into the tapping spout is high, which leads to the defects mentioned above.

In practice, when the leakage rate is high it is necessary to use these two modes of regulation in alternation, even if this means accepting a certain amount of air being drawn in rather than too great an excess of inert gas. Consequently, management of the regulation is complex and necessarily includes compromises between two types of disadvantages.

The inert gas used is generally argon. The use of argon entails a high cost given that the shroud channel must be permanently supplied and that leaks can be considerable.

This is particularly true if the shroud channel consists of an external chamber which cannot easily be sealed and which requires a high flow rate of gas in order to maintain an overpressure therein. This drawback is particularly important in applications of continuous tapping between ladle and tundish.

Moreover, refractory wear pieces are known, from French Patent Application FR 85/02625, which make it possible to introduce, in the actual refractory, an impregnation substance which clogs up the pores in the refractory. This technique prevents infiltration of liquid metal into the pores of the refractory. However, it does not solve the problem of making the joints between successive refractory assemblies gas-tight.

The subject of the present invention is specifically a plant for transferring liquid metal which does not have the drawbacks mentioned above.

The subject of the invention is also a method of improving the sealing of the mating surfaces between refractory assemblies during the use of the tapping spout.

The invention relates to a plant for transferring liquid metal, in particular steel, between an upstream container and a downstream container. Such a plant generally comprises a tapping spout via which the liquid metal flows from the upstream container into the downstream container, this spout being delimited by a set of refractory assemblies placed between the two containers. Each refractory assembly of the tapping spout has at least one surface forming a mating surface with a corresponding surface of an adjacent refractory assembly. A flow regulator makes it possible to regulate the flow of liquid metal through the tapping spout. A shroud channel is placed around the tapping spout near at least one mating surface between refractory assemblies. This shroud channel has an inlet capable of allowing materials to enter.

SUMMARY OF THE INVENTION

The invention is characterized in that the plant comprises means for introducing a sealing agent into the shroud channel. This plant may also include means for injecting an inert gas into the shroud channel.

In a preferred variant of the invention, the means for introducing a sealing agent comprise a cartridge mounted on a pipe connected to the inlet of the shroud channel. Advantageously, these means enable predetermined doses of sealing agent to be introduced into the shroud channel.

Preferably, the shroud channel comprises an outlet capable of allowing an excess of sealing agent and/or of a fluid, for example the inert gas, to escape. The shroud channel advantageously comprises an inlet at one end and an outlet at the other end. The said channel is preferably linear and continuous. The outlet enables any excess of sealing agent to be discharged to the outside of the plant.

In one embodiment of the invention, means capable of maintaining a pressure at the outlet of the shroud channel are connected to the outlet of the shroud channel, while still allowing an excess of sealing agent to escape. These means may be a calibrated head loss. This calibrated head loss is open to atmosphere. The function fulfilled by this calibrated head loss will be explained below.

The invention also relates to a method of operating a plant for transferring the liquid metal as described above, characterized in that a sealing agent is introduced into the shroud channel.

The sealing agent may be a pulverized product, and in particular a powder. This powder may advantageously consist of particles of various sizes. The powder may be chosen from graphite and another refractory material not impairing the quality of the metal. The powder may also be a fusible product such as an enamel, the viscosity of which in the liquid state is sufficient to close off, at least partially, the leaks in the shroud channel.

The sealing agent may also be chosen from paints and resins. This agent then covers the walls of the shroud channel with an impermeable layer.

The sealing agent may also be a non-volatile product, chosen from salts and metals, which is liquid at the temperature of the shroud channel. This non-volatile product may advantageously be introduced in the form of a wire which melts when it enters the shroud channel 18, 40. Preferably, an aluminum wire is used.

Finally, the sealing agent may be produced by the reaction of at least two substances which are inactive at ambient temperature but which react together at the temperature of the shroud channel.

This sealing agent may be introduced continuously or intermittently. An inert gas may be used for transporting this sealing agent into the shroud channel.

A first method, in which inert gas is injected into the shroud channel, includes the following steps:

- the pressure of the inert gas at the inlet of the shroud channel is set at a predetermined value;
- the corresponding flow rate of inert gas injected into the shroud channel is measured;
- the sealing agent is introduced into the shroud channel when the value of the said flow rate exceeds a predetermined value.

A second method, in which inert gas is injected into the shroud channel, includes the following steps:

- the flow rate of the inert gas injected into the shroud channel is set at a predetermined value;
- the pressure of the inert gas at the inlet of this channel is measured;
- the sealing agent is introduced into the shroud channel when the value of the said pressure falls below a predetermined value.

A third method, in which the inert gas is injected into the shroud channel, applicable when the shroud channel has an outlet, includes the following steps:

- the flow rate of inert gas injected into the shroud channel is regulated to a set value;
- the pressure of the inert gas at its entry into the shroud channel is measured;
- the flow rate of inert gas at the venting outlet is determined;
- the set value of the flow rate of inert gas injected into the shroud channel is adjusted in such a way that the flow rate of inert gas at the venting outlet is always positive;
- the flow rate of inert gas drawn into the tapping spout is determined by the difference between the flow rate of inert gas injected into the shroud channel and the flow rate of inert gas at the venting outlet;
- a sealing agent is introduced into the shroud channel when the said flow rate of inert gas drawn into the tapping spout exceeds a permitted limit.

The flow rate of inert gas at the outlet of the shroud channel is advantageously determined by measuring the pressure difference resulting from the flow of the inert gas in a calibrated head loss connected to the outlet of the shroud channel. Since the head loss in the shroud channel itself is low, the pressure measured at the inlet of the shroud channel is practically equal to this pressure difference. This method therefore applies if the plant for transferring liquid metal includes, at the outlet of the shroud channel, means capable of maintaining a pressure, such as a calibrated head loss.

BRIEF DESCRIPTION OF THE DRAWINGS

Other characteristics of the invention will appear on reading the description which follows, reference being made to the appended figures. In these figures:

FIG. 2 is a detailed view, in vertical cross-section, of a plant for transferring liquid metal according to the invention, including means for introducing a sealing agent;

FIG. 3 is a detailed view, in vertical cross-section, of such a plant according to the invention, in which the means for introducing a sealing agent comprise a cavity made within an actual refractory assembly;

FIG. 4 is a detailed view, in vertical cross-section, of a plant for transferring liquid metal according to the invention, in which a linear shroud channel consists of a groove, having an inlet and an outlet, made in a refractory assembly;

FIG. 5 is a view similar to FIG. 4, in which the shroud channel consists of a chamber;

FIG. 1 shows a plant for transferring liquid metal according to the prior art. It includes an upstream container 2. In the example shown, the upstream container 2 is a tundish which has a steel bottom wall 4 covered with a layer of refractory 6. A taphole is provided in the bottom of the tundish. This taphole is delimited by an internal nozzle 8 which is mounted in the thickness of the refractory and passes through the steel bottom wall 4. The plant also comprises a downstream container 10. In the example shown, the downstream container 10 consists of a continuous-casting mould.

Figure 1:
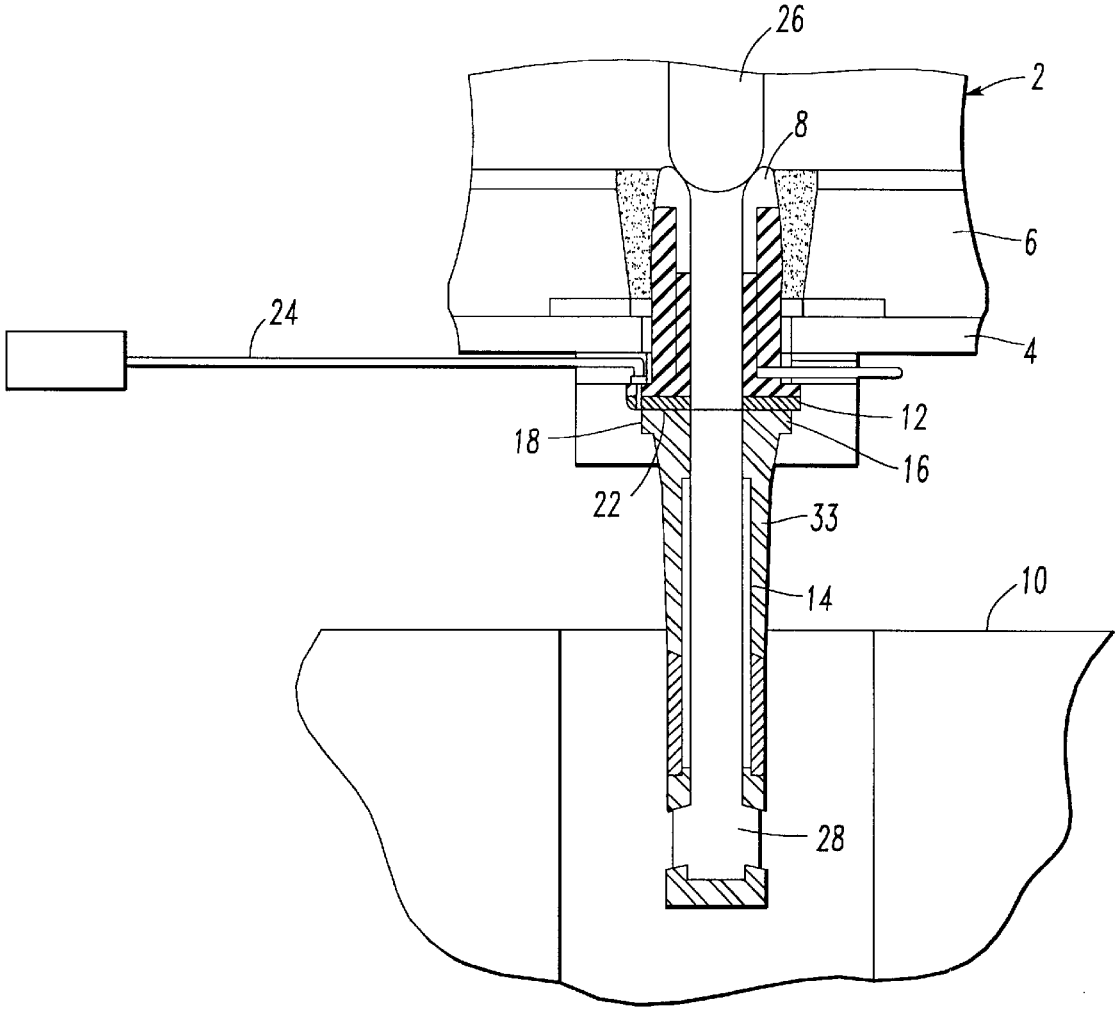
FIG. 1 is an overall view, in vertical cross-section of a plant for transferring liquid metal according to the prior art.

The internal nozzle 8 terminates at its lower part in a plate 12. Under the internal nozzle 8 is a jet shroud tube 32 terminated at its upper part in a plate 16 which matches the plate 12 of the internal nozzle 8. In a known manner, the plates 12 and 16 are pressed against each other by known means so as to seal them as completely as possible. A closed shroud channel 18 consists of an annular groove 20 made in the mating surface 22 between the plate 12 and the plate 16. A pipe 24 for supplying an inert gas is connected to this groove 20. Denoted by the reference 26 are means for regulating the flow of the metal, in this case a stopper rod. The internal nozzle 8 and the jet shroud tube 32 delimit a tapping spout 28 via which the metal flows from the upstream container 2 into the downstream container 10. In the embodiment example shown, the plant has only two refractory assemblies (the internal nozzle 8 and the jet shroud tube 32), but it could have more of them, for example in the case of a plant equipped with a slide gate valve having three plates. Each refractory assembly 8, 32 delimiting the tapping spout 28 has at least one surface forming a mating surface 22 with a corresponding surface of an adjacent refractory assembly.

FIG. 2 is a detailed view of part of a plant for transferring liquid metal according to the invention. The figure shows a collecting nozzle 30 inserted into a jet shroud tube 32, which thus form a tapping spout 28. The junction between the two refractory assemblies has a mating surface 22. A closed shroud channel 18 consists of an annular groove 20 made in the mating surface 22 of the jet shroud tube 32 with the collecting nozzle 30. A pipe 24 for supplying the inert gas is connected to this annular groove 20.

A cartridge 32 contains a sealing agent, and a metering apparatus 34 is used to introduce the sealing agent into the inert-gas supply pipe 24. This metering apparatus 34 may be a rotary dispenser, including a cylinder, and each rotation of which introduces a predetermined quantity of the sealing agent into the inert gas supply pipe 26.

The metering apparatus 34 may be controlled manually. Its operation may also be automated. The introduction may be continuous or intermittent. The sealing agent, in this embodiment, is transported by the stream of inert gas which therefore acts as a carrier fluid. The sealing agent therefore enters the shroud channel 18 and is entrained by the inert gas into the interstices between the refractory assemblies 30 and 32. It therefore plugs up these interstices. As a result, there are consequently two advantages: firstly, the flow rate of gas taken into the tapping spout 28, and disturbing the tapping of the liquid metal, is decreased; secondly, the consumption of gas is reduced, which is an economic factor.

In the example shown in FIG. 2, the sealing agent is a powder conveyed by a carrier gas. Advantageously, this powder may consist of particles of different size. Thus, the coarse particles obstruct the largest leaks and the finest particles complete the process of closing off the smaller leaks and the interstices between the coarse particles. Preferably, flat particles are used, i.e. flakes. Flakes have the following advantages: they are more easily transported by the flow of carrier gas; they deform so as to match the shape of the interstices to be obstructed. The powder may consist of graphite or of another refractory not impairing the quality of the metal.

The invention also relates to other forms of sealing agent and other modes of introduction of the latter. The mode of introduction may include the use of an inert gas as carrier fluid. The sealing agent may also be introduced into the shroud channel 18 without the help of a carrier fluid. The sealing agent may be a liquid. In particular, it may be a product such as a grease or an oil which may be introduced in liquid or viscous form. Such products generate, by cracking, solid products which ensure that the leaks are closed off, and volatile products which are discharged. In this variant, it is advantageous to provide, in the shroud channel 18, at least one outlet orifice so that the volatile products can escape to the outside of the plant and not into the tapping spout 28. The sealing agent may also be a solid product such as a metal wire. Such a sealing agent is solid at ambient temperature but melts at the temperature prevailing inside the shroud channel.

FIG. 3 shows a variant of a plant for transferring liquid metal according to the invention. In this, a cartridge 36 containing a sealing agent is placed in a cavity in the plate 38. The cartridge 36 may have a fusible casing which will melt when the plate 38 is put into service in a device such as a slide gate valve or a tube changer. The pipe 24 for supplying the inert gas is connected to the upper part of the cartridge 36 in such a way that, when the fusible casing melts, the sealing agent is entrained into the shroud channel 18. A refractory of this type can be used very simply in an existing plant without it having to be modified. All that is required is to fit a refractory plate such as 38, having an integrated cartridge 36 instead of a conventional plate. A single dose of sealing agent will be introduced into the plane of the mating surface 22 between the plates 38 and 16 in order to close off the leaks existing between them.

Both in the embodiment shown in FIG. 2 and that in FIG. 3, the shroud channel 18 is a closed annular channel having a supply of inert gas. Introducing a sealing agent into this shroud channel 18 makes it possible to improve the sealing and therefore the protection of the liquid metal afforded by the shroud channel 18. However, these two embodiments do not make it possible to guarantee that the sealing agent is distributed uniformly along the entire length of the shroud channel.

FIG. 4 shows a plant for transferring liquid metal according to an embodiment of the invention. In this, the shroud channel 40 consists of a groove 42 which is not annular but linear, and has an inlet 44 at an end connected to the inert-gas supply pipe 24 and an outlet 46 at the other end.

This open arrangement of the shroud channel 40 makes it possible to guarantee that the flow of inert gas entrains the sealing agent into the entire shroud channel. Everywhere in the shroud channel 40, the speed of flow of the inert gas is sufficient and prevents blockages in the shroud channel 40 by the sealing agent, in particular in those sensitive parts of this channel such as the bends, the regions having a change in cross-section and the rising regions.

The outlet 46 prevents an overpressure of inert gas being created in the shroud channel 40. A device may be fitted to the outlet of the shroud channel 40 which enables a slight overpressure to be maintained in this channel, while still allowing any excess sealing agent to escape. Such a device is, for example, a simple head loss.

In the example shown in FIG. 4, the shroud channel has a helical shape. This embodiment is particularly suitable for conical mating surfaces. In the example shown, the groove 42, the inlet 44 and the outlet 46 are made in a single refractory assembly 32, but these three elements could be made on the other refractory assembly 30, in totality or in part, without departing from the scope of the invention.

FIG. 5 is a detailed view of part of a plant or transferring liquid metal according to the invention, similar to those shown in FIGS. 2 and 4. Apart from the shroud channels 40, 18 shown in FIGS. 2 and 4, the shroud channel shown in FIG. 5 is a chamber 48 produced by means of a shell 50 surrounding the periphery of the mating surface between the collecting nozzle 30 and the jet shroud tube 32. According to the invention, a sealing agent can be introduced into the shroud channel 48. A seal 52 ensures that the chamber 48 is sealed. This chamber may be fed with a pressurized inert gas via the pipe 24 in a similar way to that described previously. In this manner, it is not air which is drawn into the tapping spout 28 but the inert gas contained in the chamber 48. The chamber 48 may be annular and closed, and have only one inlet 44. In an alternative form, it may have an outlet 46. In this case, the chamber advantageously has a linear and continuous arrangement, the inlet 44 being at one end and the outlet 46 at the other.

Figure 6:
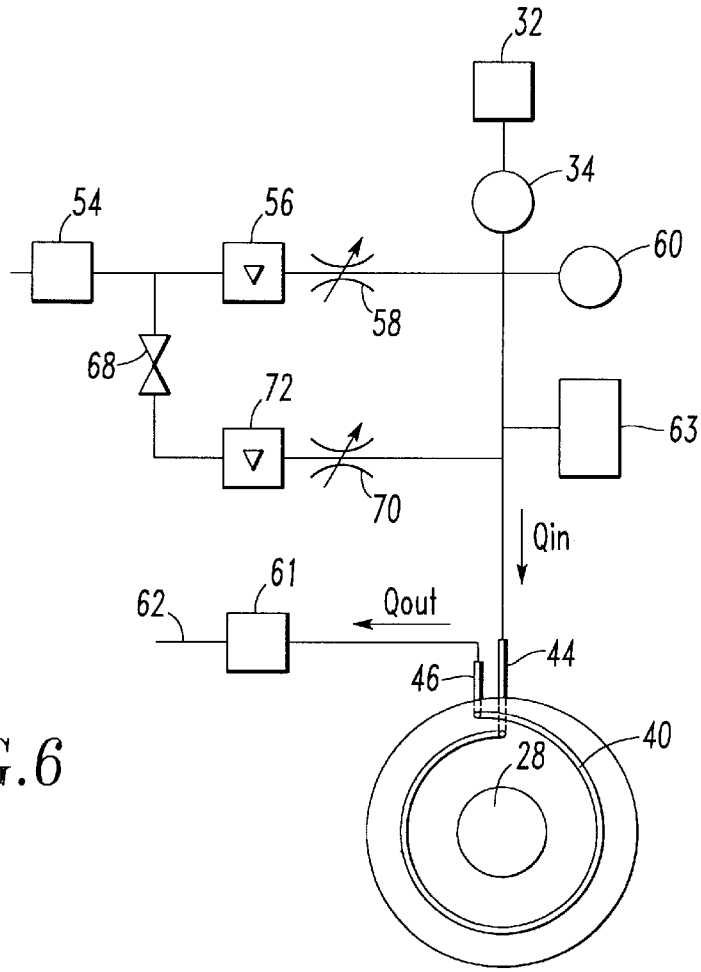
FIG. 6 is a diagrammatic representation of a plant according to the invention and of its auxiliary circuits, including means for injecting inert gas and for introducing a sealing agent.

The various methods of using a plant according to the invention and its accessories will now be described in more detail, with reference to FIG. 6, in the case in which an inert gas is used for transporting the sealing agent.

The inert-gas feed consists of a source, which may, for example, be a cylinder, of a pressure-reducing valve 54, of a flow meter 56 and of a regulator 58 which is used to regulate the flow rate or the pressure.

In a first method, the pressure $P_{in}$ of the inert gas at the inlet 44 of the shroud channel is set at a predetermined value and the corresponding flow rate of the inert gas injected into the shroud channel is measured. The pressure gauge 60 indicates this pressure. The flow meter 56 indicates this flow rate. When this flow rate exceeds a predetermined value, indicating by this that an excessive flow rate of inert gas is being taken into the tapping spout 28, a quantity of the sealing agent is introduced. The value of the pressure $P_{in}$ may be about 0.2 bar. This method preferably applies in plants in which the shroud channel 40, 18 is closed, or when this channel is open but has, at its outlet 46, a head loss 61.

In a second method, the flow rate of the inert gas at the inlet 44 of the shroud channel 40, 18 is set at a predetermined value and the corresponding pressure of inert gas injected into the said channel is measured. When this pressure falls below a predetermined value, indicating by this that an excessive flow rate of inert gas is being taken into the tapping spout 28, a quantity of the sealing agent is introduced. The predetermined value of the flow rate of inert gas is chosen in such a way that it is greater than the maximum possible flow rate of inert gas taken into the tapping spout 28 and in such a way that there is therefore always an excess of inert gas. This method preferably applies in plants in which the shroud channel 40, 18 is open and when this channel has, at its outlet 46, a head loss 61. The opening 46 makes it possible, in fact, to discharge the excess of inert gas and excess of sealing agent to the outside of the plant. This opening also makes it possible to maintain the pressure in the shroud channel 40 at a low value. Thus, while still being sure that only inert gas can be drawn into the tapping spout 28, the quantity of inert gas drawn into the tapping spout is reduced to the minimum compatible with the state of the mating surface 22 since the pressure in the shroud channel is reduced. This method offers the advantage of very great simplicity in the management and optimum efficiency. Introduction of the sealing agent may also be continuous, since the excess sealing agent is automatically entrained to the outside via the outlet 46 together with the excess of inert gas. There is no risk of blocking the gas pipe 24 or the shroud channel 40 by accumulation of sealing agent. Another advantage of the method is that, since the circuit has no dead zone, the inert gas flows along the entire length of the shroud channel 40 with a speed sufficient to ensure that the sealing agent is transported into every place where it may be necessary.

A third method is an improvement of the previous method and makes it possible to control the introduction of a sealing agent when the flow rate of inert gas being drawn into the tapping spout 28 exceeds a permissible limit. With regard to this method, a second flow meter is added at the outlet 46 of the shroud channel so as to measure the excess inert gas escaping via the said outlet. Thus, it is possible to know the flow rate of inert gas actually drawn into the tapping spout 28 by difference with the flow rate $Q_{in}$ of inert gas injected into the shroud channel 40. The flow meter is advantageously produced by means of a calibrated head loss 61 and a pressure gauge 60. The rate of flow $Q_{out}$ passing through the calibrated head loss 61 generates a slight overpressure $P_{in}$ in the shroud channel 40 which is read by the pressure gauge 60. The relationship between the is pressure $P_{in}$ measured by the pressure gauge 60 and the flow rate $Q_{out}$ of inert gas escaping via the outlet 62 is provided by known empirical relationships of the form:

$$Q_{out}=K*f(P_{in})$$

where K is a calibration coefficient of the calibrated head loss.

Since the head loss of the shroud channel 40 is low, the pressure $P_{in}$ measured by the pressure gauge 60 at the inlet of the shroud channel 40 is approximately equal to the pressure that would be measured at the outlet 46 of this channel. Placing the pressure gauge 60 at the inlet 44 of the shroud channel makes it possible to avoid the difficulties in connecting the latter to the outlet. These difficulties comprise difficulties with regard to the environment in the vicinity of the tapping spout 28 and the fouling of the pressure gauge by the excess sealing agent.

By producing the calibrated head loss in the form of a tube having a diameter of from 3 to 4 mm and a length of from 1 to 4 m, a low overpressure (from 0.1 to 0.3 bar) is generated, this being barely prejudicial to the leakage rate. This embodiment offers the advantage of being able to measure the excess flow escaping via the outlet of the shroud channel 40 remotely. Another advantage of this method is that this form of flow meter is extremely simple and robust and can be installed directly at the outlet of the refractory, despite the difficulties specific to the difficult environment. It is therefore not necessary to fit an additional pipe for installing the flow meter in a protected and operator-accessible place.

This third method therefore makes it possible to evaluate at any moment the leakage rate of inert gas drawn into the tapping spout 28 and to introduce, either manually or automatically, sealing agent when this flow rate exceeds an acceptable limit.

Continuous introduction of the sealing agent is preferred when the quality of the mating surface may be impaired at any moment. This is particularly the case with mating surfaces between plates 64, 66 of a slide gate valve for regulating the tapping jet, which undergo frequent movement and therefore run the risk of creating new leaks at any moment. This is also the case for the mating surfaces between a collecting nozzle 30 of a ladle slide gate valve and a jet shroud tube 32. The movements of the slide gate valve and the vibrations of the tube 32 which are induced by the flow of the liquid metal may at any moment cause a deterioration in the quality of the mating surface 22.

An application of the invention, described below, will preferably be used in the case of mating surfaces which are for the most part static during tapping but which may be altered periodically. This is in particular the case for the tube changes as described in Patent U.S. Pat. No. 4,569,528. In such a tube changer, the tube at its upper part has a plate which is pressed firmly against a stationary plate of the upstream container. When the tube is worn, it is replaced by a fresh tube, generally by sliding a new tube against the stationary upper plate. The mating surface 22 is generally greatly impaired by the operation of changing a tube, whereas it is only rarely impaired during the lifetime of the tube, the mating surface 22 then being static. For such an application, a preferred variant of the method according to the invention consists in initiating the introduction of the sealing agent only when the state of quality of the mating surface 22 requires it. When the leakage rate rises above a predetermined acceptable value, i.e. when the pressure read by the pressure gauge 60 drops below a predetermined threshold, introduction of the sealing agent is triggered. As soon as the leakage rate has been reduced to a predetermined value, that is to say that the pressure at the pressure gauge 60 has risen above a threshold, introduction of the sealing agent is stopped.

This method can be easily automated by adding a double-threshold pressure detector 63.

An improvement applicable to each of the methods according to the invention mentioned above consists in providing an additional inert-gas feed line consisting of a valve 68, optionally controlled, a flow regulator 70 and a flow meter 72. The valve 68 is opened simultaneously with the triggering of the introduction of sealing agent so as to deliver an additional flow of inert gas during this introduction. This improvement offers the advantage of being able to set the main flow rate of inert gas delivered by the regulator 58 at a relatively low value, for example 10 N 1/min, which is sufficient during the normal tapping operation, when the mating surface 22 is sealed correctly, and of having a sufficiently high flow rate when the mating surface 22 has deteriorated, for example after changing a tube, in order to maintain an excess of inert gas, to guarantee effective transport of the sealing agent and to remove the excess sealing agent via the outlet 46.

Figure 7:
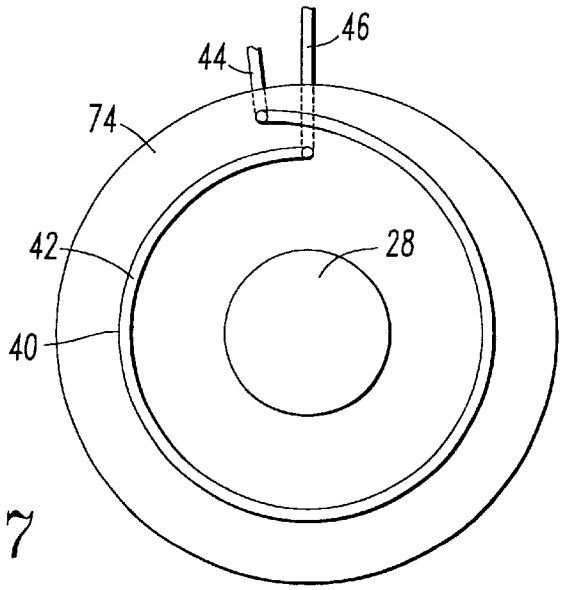
FIG. 7 is a view from above of a detail of a plant according to the invention, showing a refractory assembly in which a linear shroud channel consists of a groove having an inlet and an outlet.
Figure 8:
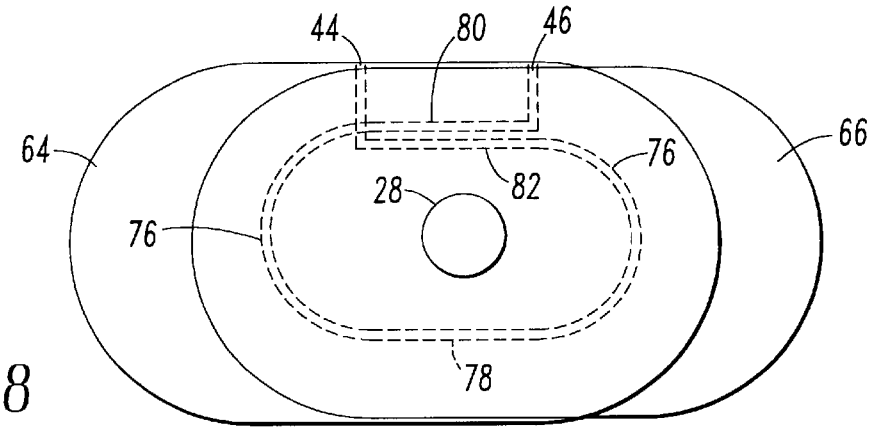
FIGS. 8 and 9 are views from above and from the front of two plates of a slide gate valve of a plant for transferring liquid metal according to the invention, the slide gate valve being in the fully open position.
Figure 9:
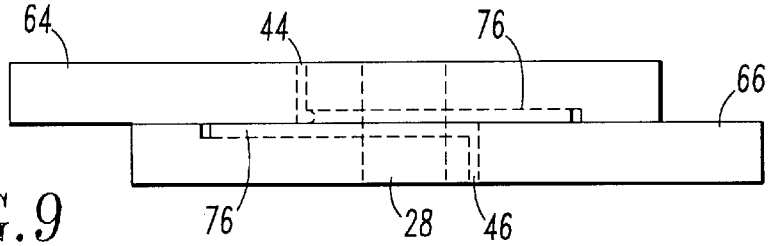
Figure 10:
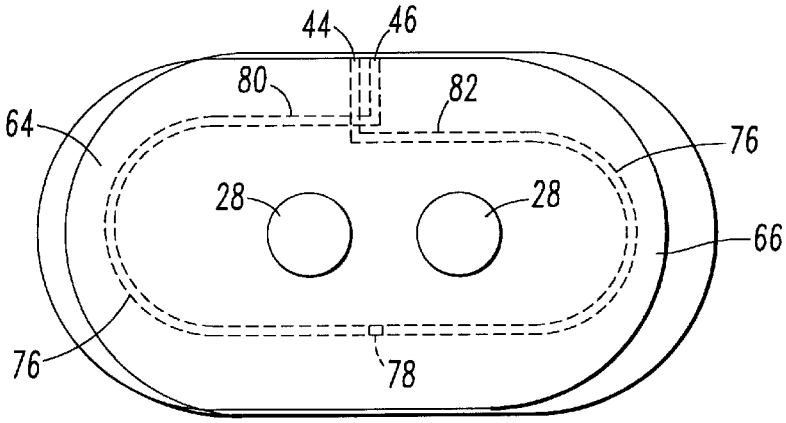
FIGS. 10 and 11 are views from above and from the front of these same two plates, the slide gate valve being in the fully closed position.
Figure 11:
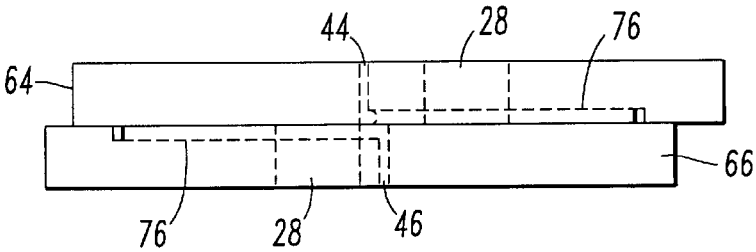

FIG. 7 is a view from above of a refractory assembly 74 according to the invention. The inlet 44 and the outlet 46 of the shroud channel 40 consisting of a linear groove 42 emerge on the periphery of the refractory assembly via holes drilled in the mass of the refractory. This refractory assembly 74 could, for example, be a lower face of an internal nozzle, an upper face of a jet shroud tube, a plate of a tube changer or, more generally, any section of a tapping spout 28.

FIGS. 8, 9, 10 and 11 show an embodiment example of a device according to the invention consisting of an upper plate 64 drilled with a hole forming a tapping spout 28, a lower plate 66 also having a hole, these plates being capable of sliding horizontally with respect to each other, and thus enabling the flow of liquid metal to be regulated by varying the opening of the tapping spout 28. The two plates each have a U-shaped groove 76. Unlike the grooves known in the prior art, for example from French Patent FR 74/14636, the two superposed Us overlap only by one of their arms, over a portion of their length 78 which can vary depending on the relative position of the two plates 64 and 66. The arms 80 and 82 do not overlap and are connected, at their respective ends, to the outlet 46 and to the inlet pipe 24. In this plant, there is therefore a continuous linear shroud channel 40 having an inlet at one end and an outlet at the other, surrounding the tapping spout 28. This arrangement thus makes it possible to adopt the method of regulating the injection of inert gas according to the invention by fitting a calibrated head loss either within the lower plate 66, or connected to the outside of the latter.

The distance between the arms of the U of the upper plate 64 is different from the distance between the arms of the U of the lower plate 66. At least one of these Us is therefore unsymmetrical with respect to the hole forming the tapping spout 28.

This embodiment is particularly suitable for the system known as a nozzle with a slide gate valve. It illustrates that the invention may be applied to a wide variety of plants for transferring liquid metal.

What is claimed is:

1. An apparatus for transferring liquid metal from an upstream container, through a bore defined by a set of refractory assemblies where each assembly has at least one mating surface forming a joint with a corresponding mating surface of an adjacent assembly, and into a downstream container, the apparatus comprising:

(a) a sealing channel around the bore, at least partially level with the mating surface, and having an inlet; and (b) means for introducing a sealing agent into the sealing channel, the means comprising a carrier fluid.

2. The apparatus of claim 1, wherein the means for introducing the sealing agent comprises a cartridge mounted on a pipe connected to the inlet of the sealing channel.

3. The apparatus of claim 1, wherein the means for introducing the sealing agent permits predetermined doses of sealing agent to be introduced into the sealing channel.

4. The apparatus of claim 1, wherein the sealing channel includes an outlet capable of allowing material to escape.

5. The apparatus of claim 4, wherein the sealing channel has a first end and a second end, the inlet being at the first end and the outlet being at the second end.

6. The apparatus of claim 4, wherein the sealing channel is continuous.

7. The apparatus of claim 4, wherein a means for maintaining pressure at the outlet of the sealing channel is connected to the outlet and allows material to escape.

8. The apparatus of claim 7, wherein the means for maintaining pressure comprises a calibrated head loss terminated by a venting outlet.

9. The apparatus of claim 1, wherein the sealing channel has interior walls substantially covered by an impermeable layer formed by the sealing agent.

10. A method of protecting a stream of liquid metal in a bore defined by a set of refractory assemblies and a sealing channel around the bore, the method comprising introducing a sealing agent into the sealing channel with a carrier fluid.

11. The method of claim 10, wherein the sealing agent is introduced as a wire that melts after entering the sealing channel.

12. The method of claim 10, wherein the sealing agent is introduced as at least two substances that are inactive at ambient temperature and react together at casting temperature.

13. The method of claim 10, wherein the sealing agent is introduced continuously.

14. The method of claim 10, wherein the sealing agent is introduced intermittently.

15. The method of claim 10, wherein the carrier fluid comprises an inert gas.

16. The method of claim 10, further comprising:

(a) introducing the carrier fluid at a constant pressure;

(b) measuring a flow rate of the carrier fluid introduced; and (c) introducing the sealing agent when the flow rate exceeds a predetermined value.

17. The method of claim 10 further comprising:

(a) introducing the carrier fluid at a constant flow rate into the sealing channel;

(b) measuring a pressure of the carrier fluid in the sealing channel; and (c) introducing the sealing agent when the pressure falls below a predetermined value.

18. The method of claim 10 further comprising:

(a) introducing the carrier fluid at a constant inlet flow rate into an inlet of the sealing channel;

(b) measuring an outlet flow rate of the carrier fluid at an outlet of the sealing channel;

(c) adjusting the inlet flow rate to maintain the outlet flow rate as positive;

(d) determining the difference between the inlet flow rate and the outlet flow rate; and (e) introducing the sealing agent when the difference exceeds a permitted limit.

19. A method of protecting a stream of liquid metal while being transferred from an upstream container, through a bore defined by a set of refractory assemblies where each assembly has at least one mating surface forming a joint with a corresponding mating surface of an adjacent assembly, and into a downstream container, the method comprising introducing a sealing agent into the sealing channel with a carrier fluid.

20. The method of claim 10, wherein the sealing agent comprises a pulverized product.

21. The method of claim 10, wherein the sealing agent comprises a powder.

22. The method of claim 10, wherein the sealing agent comprises particles of various sizes.

23. The method of claim 10, wherein the sealing agent comprises a refractory material.

24. The method of claim 23, wherein the refractory material comprises graphite.

25. The method of claim 10, wherein the sealing agent comprises a fusible material capable of softening to seal leaks in the sealing channel.

26. The method of claim 10, wherein the sealing agent comprises a nonvolatile material that is liquid at casting temperature.

* * * * *